US007600276B2

(12) United States Patent
Chen et al.

(10) Patent No.: US 7,600,276 B2
(45) Date of Patent: Oct. 13, 2009

(54) BABY CRIB INCLUDING A TOP FRAME UNIT THAT CAN BE DISASSEMBLED

(75) Inventors: Shun-Min Chen, Taipei (TW); Zheng-Wen Guo, Taipei (TW)

(73) Assignee: Wonderland Nursery Goods Co., Ltd., Taipei (TW)

( * ) Notice: Subject to any disclaimer, the term of this patent is extended or adjusted under 35 U.S.C. 154(b) by 186 days.

(21) Appl. No.: 11/237,589

(22) Filed: Sep. 27, 2005

(65) Prior Publication Data

US 2007/0067907 A1 Mar. 29, 2007

(51) Int. Cl.
*A47D 7/00* (2006.01)
*A47C 7/00* (2006.01)
*A47D 13/06* (2006.01)

(52) U.S. Cl. ..... 5/99.1; 5/93.1

(58) Field of Classification Search ..... 5/99.1, 5/93.1, 114, 94, 655; 403/170, 174
See application file for complete search history.

(56) References Cited

U.S. PATENT DOCUMENTS 6,470,515 B1 * 10/2002 Hsia ..... 5/99.1

* cited by examiner

*Primary Examiner*—Robert G. Santos
*Assistant Examiner*—Jonathan J Liu
(74) *Attorney, Agent, or Firm*—Christie, Parker & Hale, LLP

(57) ABSTRACT

A top frame unit of a baby crib includes a plurality of three-way couplers and a plurality of top frame rods. Each coupler includes a root part and first, second and third tube parts that extend in different directions from the root part. The root part is formed with a cap-receiving recess that is in spatial communication with the first tube part. Each top frame rod includes a rod body that has opposite first and second rod ends, and an anchor cap that is mounted on the first rod end of the rod body. Each top frame rod is extended removably through the first tube part of one of the couplers such that the anchor cap thereof is disposed removably in the cap-receiving recess, and such that the second rod end of the rod body is extendible removably into the second tube part of another one of the couplers.

17 Claims, 5 Drawing Sheets

BABY CRIB INCLUDING A TOP FRAME UNIT THAT CAN BE DISASSEMBLED

BACKGROUND OF THE INVENTION

1. Field of the Invention

The invention relates to a baby crib, more particularly to a baby crib including a top frame unit that can be disassembled.

2. Description of the Related Art

Referring to FIG. 1, a conventional foldable baby crib 1 is shown to include a foldable bottom frame unit 11, a rectangular top frame unit 13, and four upright support rods 12 that interconnect the bottom frame unit 11 and the top frame unit 13.

The top frame unit 13 includes four angled couplers 131 and four top frame rods 132. Each of the couplers 131 is mounted on top of a respective one of the support rods 12. Each of the top frame rods 132 has opposite ends connected pivotally to an adjacent pair of the couplers 131, and includes a pair of rod segments 133 interconnected pivotally by a pivot joint 134. Therefore, each of the top frame rods 132 is foldable at the respective pivot joint 134. Each of the pivot joints 134 has a lock control unit 135 associated operably therewith to prevent undesired folding of the corresponding top frame rod 132, thereby enhancing stability of the baby crib 1.

However, when the conventional baby crib 1 is folded, the folded top frame rods 132 take up a lot of space. In particular, since the pivot joints 134 have a relatively complicated structure, they are bulky and prevent the support rods 12 from being brought close to each other when the conventional baby crib 1 is folded. As a result, high packaging and transport costs are incurred even when the conventional baby crib 1 is folded. Moreover, the inclusion of the lock control units 135 in the pivot joints 134 increases the complexity and manufacturing costs of the pivot joints 134.

SUMMARY OF THE INVENTION

Therefore, the object of the present invention is to provide a baby crib that can overcome the aforesaid drawbacks associated with the prior art.

According to one aspect of the present invention, a baby crib comprises a bottom frame unit, a top frame unit, and a plurality of upright support rods that interconnect the bottom frame unit and the top frame unit. The top frame unit includes a plurality of three-way couplers and a plurality of top frame rods.

Each of the couplers includes a root part and first, second and third tube parts that extend in different directions from the root part. The root part is formed with a cap-receiving recess that is in spatial communication with the first tube part. The third tube part is sleeved on a respective one of the upright support rods.

Each of the top frame rods includes a rod body that has opposite first and second rod ends, and an anchor cap that is mounted on the first rod-end of the rod body. Each of the top frame rods is extended removably through the first tube part of one of the couplers such that the anchor cap thereof is disposed removably in the cap-receiving recess, and such that the second rod end of the rod body is extendible removably into the second tube part of another one of the couplers.

According to another aspect of the present invention, a top frame unit is adapted for connection to a plurality of upright support rods of a baby crib, and comprises a plurality of three-way couplers and a plurality of top frame rods.

Each of the couplers includes a root part and first, second and third tube parts that extend in different directions from the root part. The root part is formed with a cap-receiving recess that is in spatial communication with the first tube part. The third tube part is adapted to be sleeved on a respective one of the upright support rods.

Each of the top frame rods includes a rod body that has opposite first and second rod ends, and an anchor cap that is mounted on the first rod end of the rod body. Each of the top frame rods is extended removably through the first tube part of one of the couplers such that the anchor cap thereof is disposed removably in the cap-receiving recess, and such that the second rod end of the rod body is extendible removably into the second tube part of another one of the couplers.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
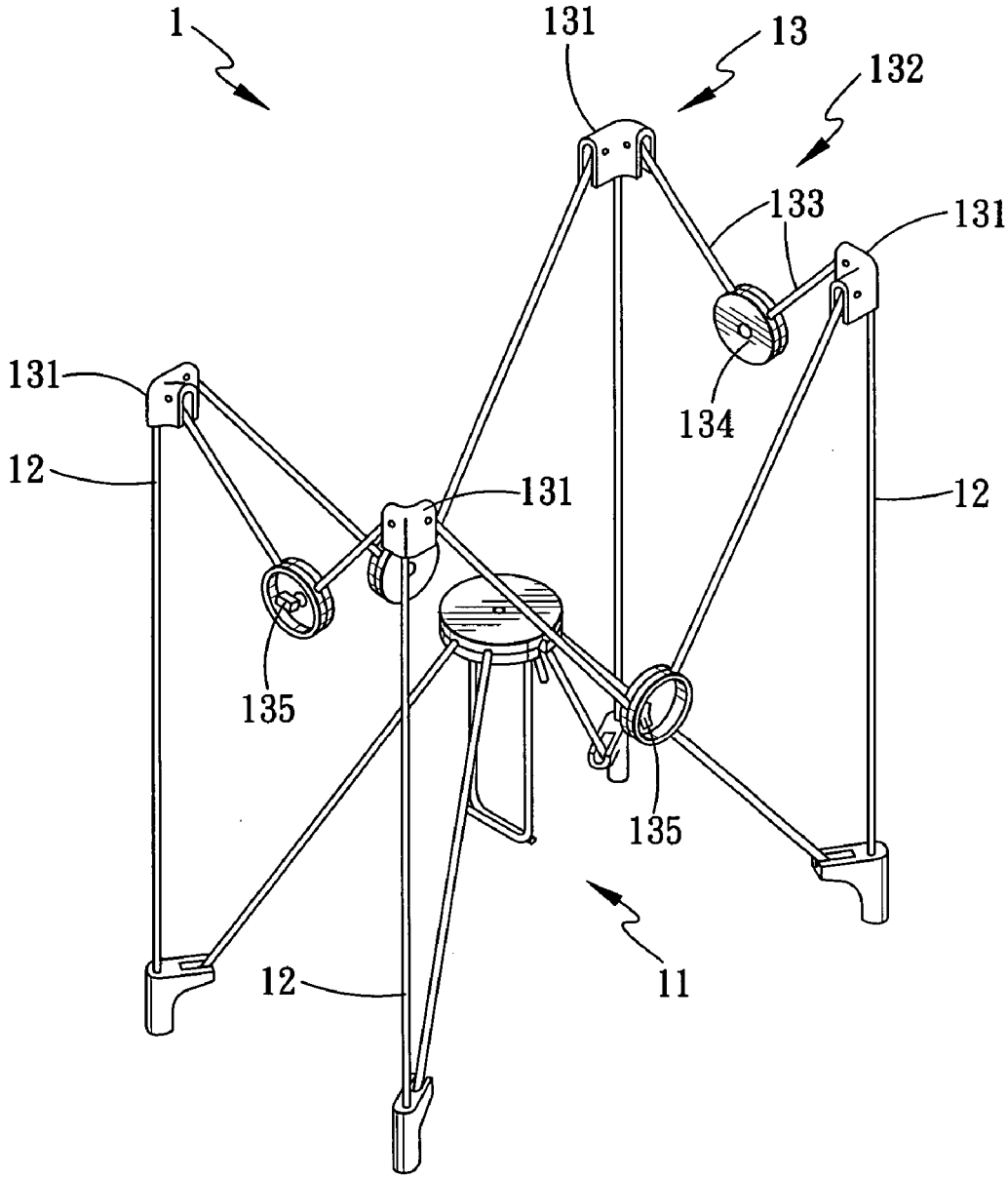
FIG. 1 PRIOR ART
FIG. 1 is a perspective view of a conventional foldable baby crib.

Before the present invention is described in greater detail with reference to the accompanying preferred embodiments, it should be noted herein that like elements are denoted by the same reference numerals throughout the disclosure.

Figure 2:
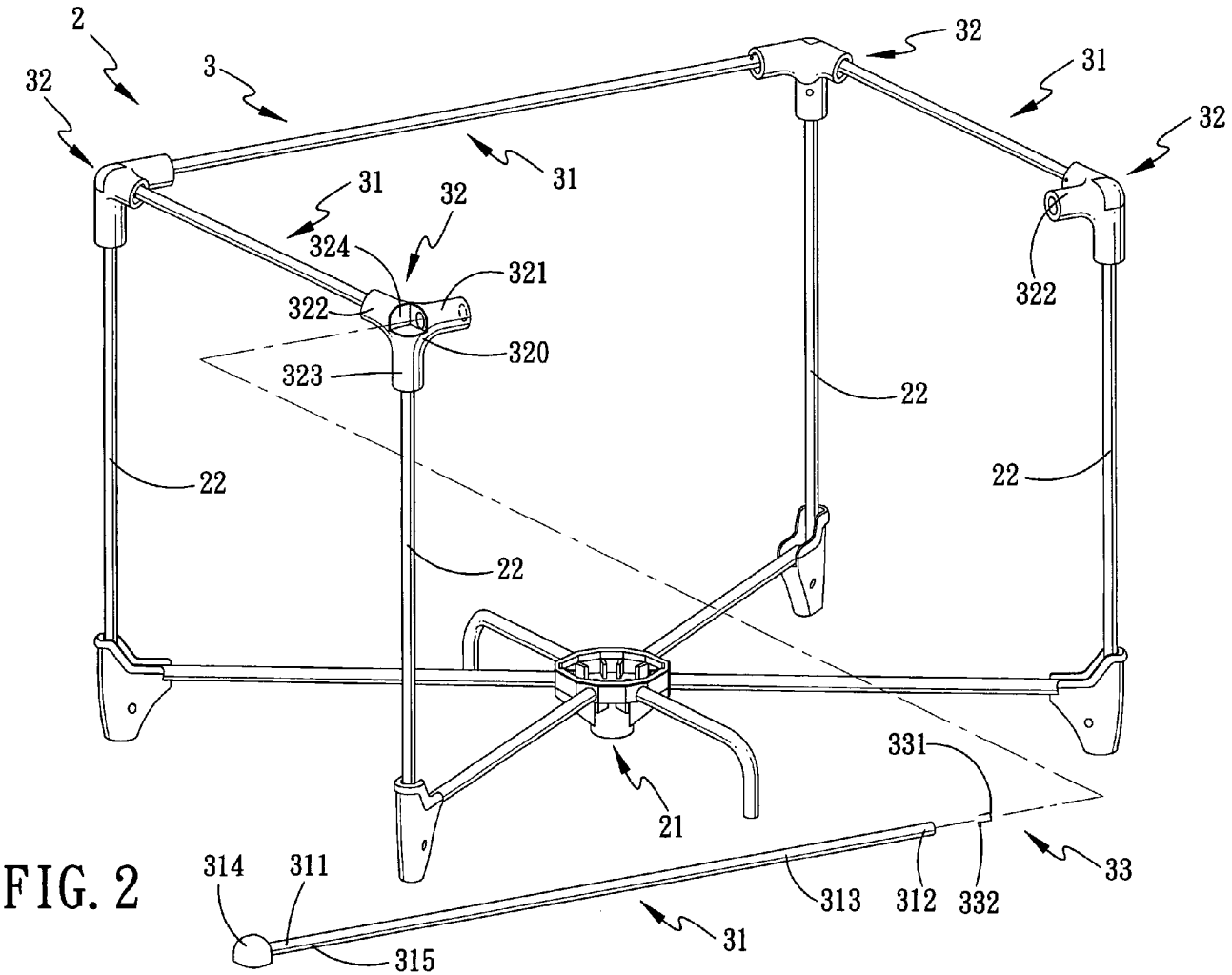
FIG. 2 is a partly exploded perspective view of the first preferred embodiment of a baby crib according to the present invention.
Figure 3:
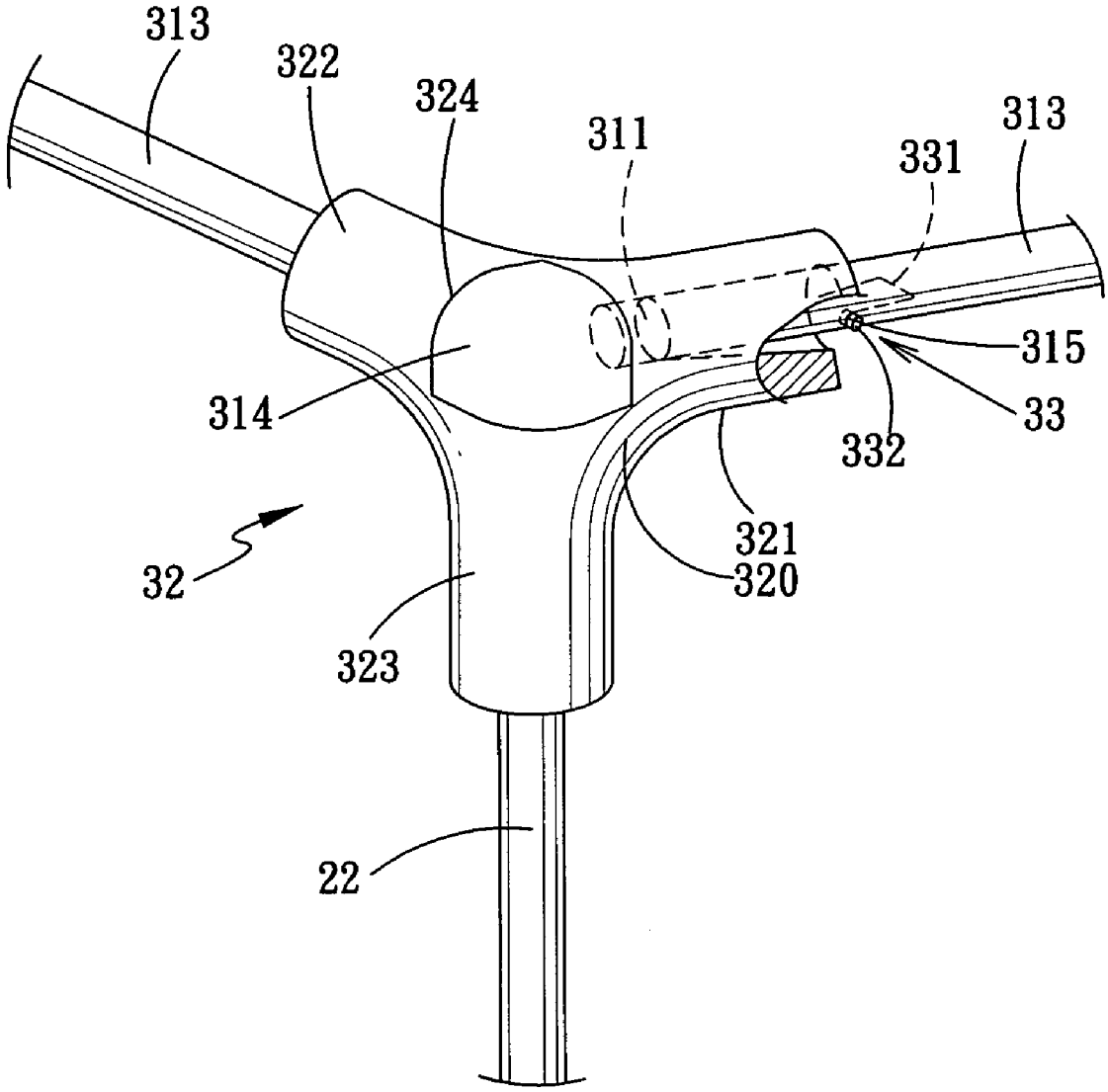
FIG. 3 is a fragmentary perspective partly cutaway view of the first preferred embodiment.

Referring to FIGS. 2 and 3, the first preferred embodiment of a baby crib 2 according to the present invention is shown to comprise a bottom frame unit 21, a top frame unit 3, and four upright support rods 22 that interconnect the bottom frame unit 21 and the top frame unit 3.

In this embodiment, the top frame unit 3 includes four three-way couplers 32 and four top frame rods 31.

Each of the couplers 32 includes a root part 320 and first, second and third tube parts 321, 322, 323 that extend in mutually orthogonal directions from the root part 320. The root part 320 is formed with a cap-receiving recess 324 that is in spatial communication with the first tube part 321. The third tube part 323 is sleeved on and may be fixed to a respective one of the upright support rods 22.

Each of the top frame rods 31 includes a rod body 313 that has opposite first and second rod ends 311, 312, and an anchor cap 314 that is mounted fixedly on the first rod end 311 of the rod body 313, such as by riveting. Each of the top frame rods 31 is extended removably through the first tube part 321 of one of the couplers 32 such that the anchor cap 314 thereof is disposed removably in the cap-receiving recess 324 in said one of the couplers 32, and such that the second rod end 312 of the rod body 313 is extendible removably into the second tube part 322 of another one of the couplers 32.

In this embodiment, the rod body 313 of each of the top frame rods 31 is a tubular body, and each of the top frame rods 31 further includes a positioning unit 33 for retaining releasably the rod body 313 on the first tube part 321 of said one of the couplers 32. Preferably, the rod body 313 of each of the top frame rods 31 is formed with a radial hole 315 that is spaced apart from the anchor cap 314, and the positioning unit 33 includes a U-shaped resilient arm 331 disposed in the rod body 313, and a stop button 332 mounted on one end of the resilient arm 331 and extending through the radial hole 315 in the rod body 313 to arrest undesired removal of the rod body 313 from the first tube part 321 of said one of the couplers 32.

While the positioning unit 33 of this embodiment includes one resilient arm 331 and one stop button 332, the positioning unit 33 may be modified to include two stop buttons 332 mounted on opposite ends of the resilient arm 331 for engaging corresponding holes 315 in the rod body 313, thereby further enhancing stability of the top frame unit 3.

In this embodiment, the bottom frame unit 21 is foldable, and is operable so as to bring the upright support rods 22 close to each other when the top frame rods 31 are removed from the couplers 32. Since the feature of this invention does not reside in the particular configuration of the bottom frame unit 21 and in the connection between the support rods 22 and the bottom frame unit 21, further details of the same are omitted herein for the sake of brevity.

To assemble the baby crib 2, the bottom frame unit 21 is first expanded, and the support rods 22 are operated to stand on a support surface. Subsequently, for each of the top frame rods 31, the stop button 332 is pressed to retract into the rod body 313. Then, the second rod end 312 of the rod body 313 is extended through the first tube part 321 of the corresponding coupler 32 via the cap-receiving recess 324 and into the second tube part 322 of an adjacent coupler 32 until the anchor cap 314 engages the cap-receiving recess 324. At this time, the stop button 332 is disposed adjacent to and outwardly of the first tube part 321 of the corresponding coupler 32, and is urged by the resilient arm 331 to extend out of the radial hole 315 in the rod body 313. As a result, the stop button 332 and the anchor cap 314 can cooperate to prevent undesired removal of the top frame rod 31 from the first tube part 321 of the corresponding coupler 32, thereby enhancing structural integrity of the top frame unit 3.

To fold and store the baby crib 2, for each of the top frame rods 31, the stop button 332 is pressed to retract into the rod body 313, and the top frame rod 31 is drawn to remove the same from the corresponding coupler 32. The bottom frame unit 21 is then folded to bring the upright support rods 22 close to each other for storage.

Since bulky pivots joints are not employed in the top frame unit 3, the structure of the top frame unit 3 is simplified to result in lower manufacturing costs. In addition, since the top frame rods 31 are removable from the couplers 32, the size of the baby crib 2 can be further reduced when folded to result in lower packaging and transport costs.

Figure 4:
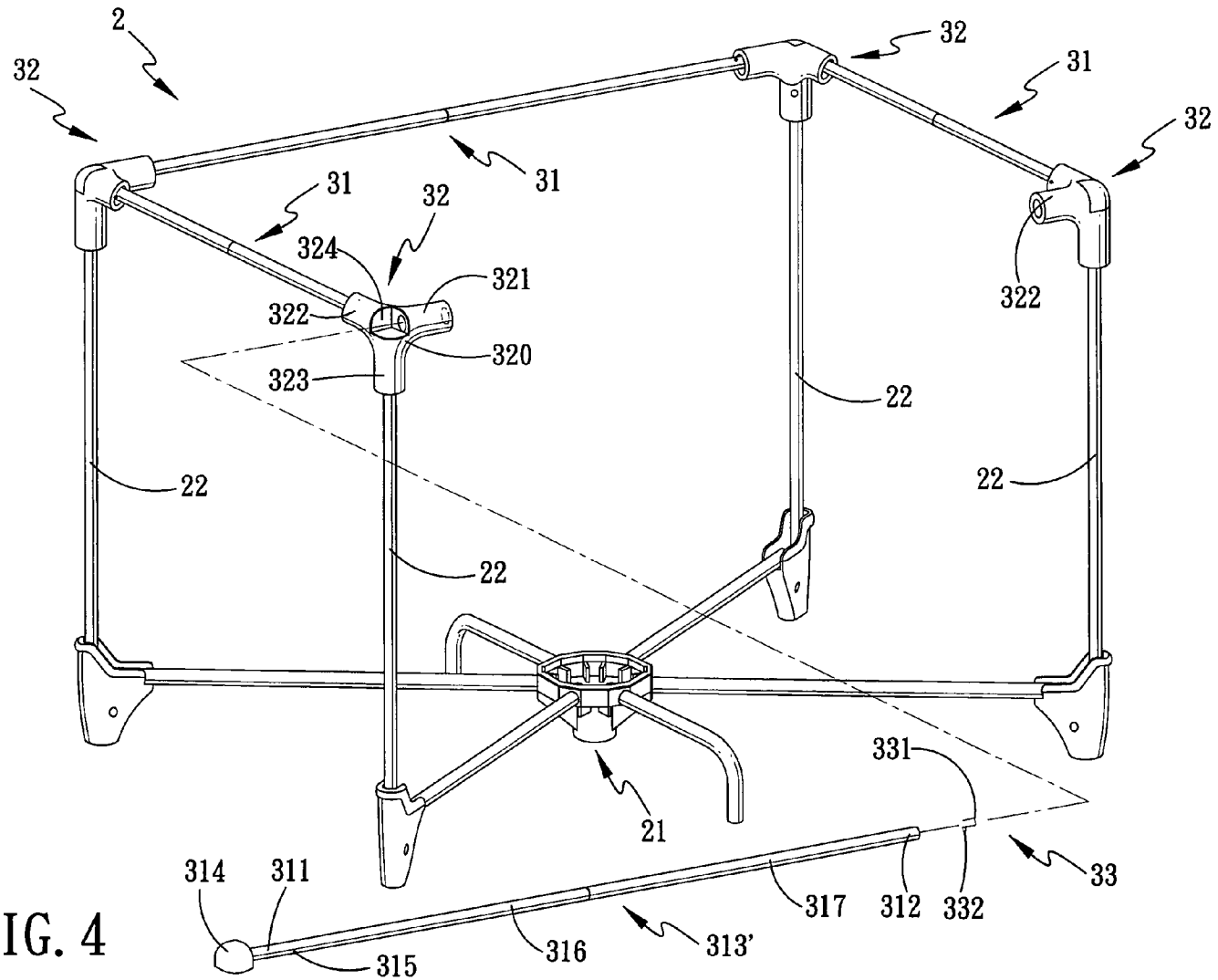
FIG. 4 is a partly exploded perspective view of the second preferred embodiment of a baby crib according to the present invention.
Figure 5:
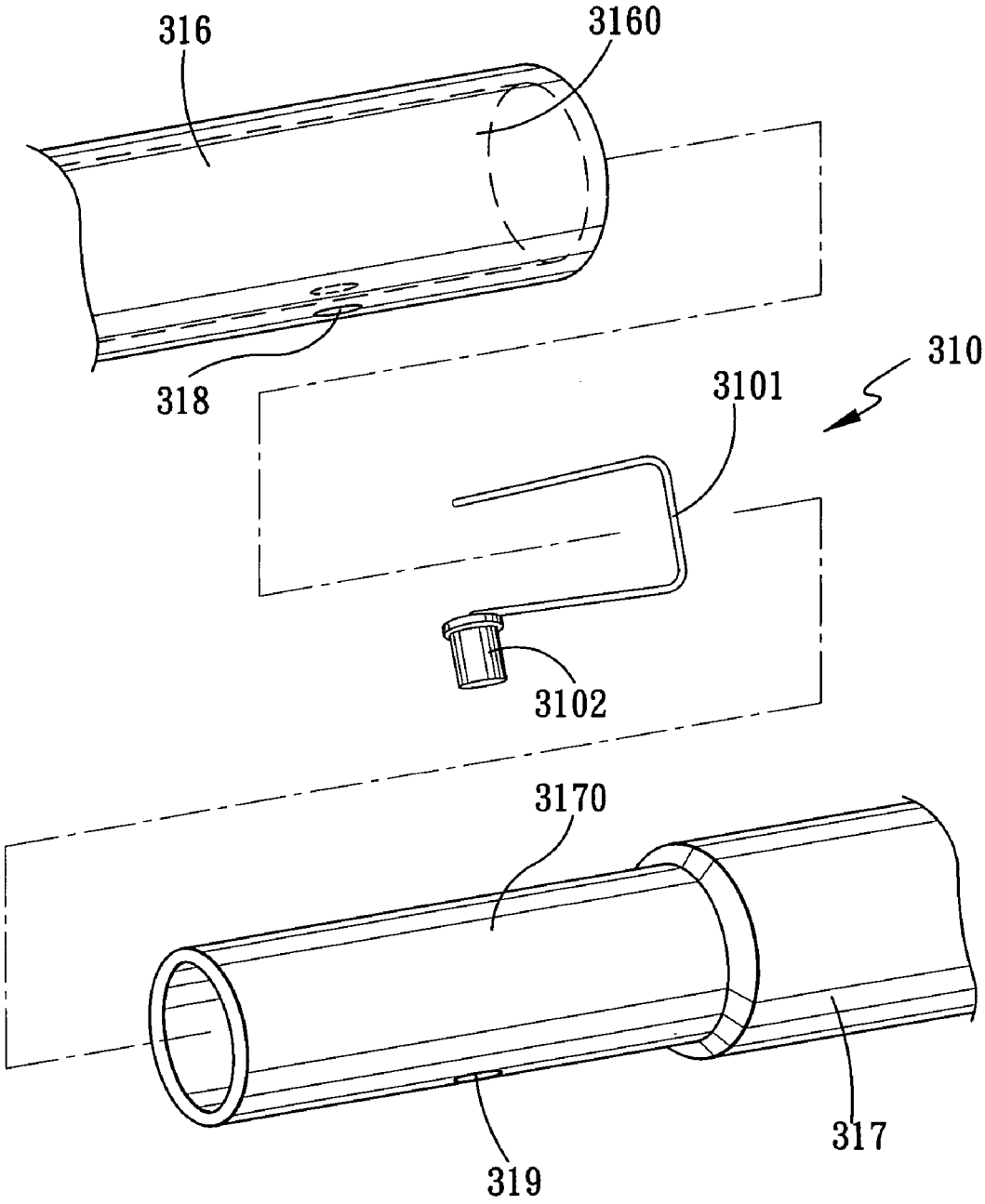
FIG. 5 is a fragmentary exploded perspective view of the second preferred embodiment.

FIGS. 4 and 5 illustrate the second preferred embodiment of a baby crib 2 according to the present invention. This embodiment differs from the previous embodiment primarily in the construction of the rod body 313' of each of the top frame rods 31. In this embodiment, the rod body 313' includes first and second tubular parts 316, 317 that are interconnected removably and that are provided respectively with the first and second rod ends 311, 312. In addition, each of the top frame rods 31 further includes a coupling unit 310 for interconnecting releasably the first and second tubular parts 316, 317 of the rod body 313'.

The second tubular part 317 has an end segment 3170 opposite to the second rod end 312, inserted removably into an adjacent end segment 3160 of the first tubular part 316, and formed with a first radial hole 319. The end segment 3160 of the first tubular part 316 is opposite to the first rod end 311. The first tubular part 316 is formed with a second radial hole 318 to be aligned with the first radial hole 319 in the second tubular part 317. The anchor cap 314 is connected to the first tubular part 316, and the radial hole 315 is formed in the first tubular part 316.

The coupling unit 310 includes a U-shaped resilient arm 3101 disposed in the end segment 3170 of the second tubular part 317, and a coupling button 3102 mounted on one end of the resilient arm 3101 and extending through the first radial hole 319 in the second tubular part 317 and into the second radial hole 318 in the first tubular part 316.

While the coupling unit 310 of this embodiment includes one resilient arm 3101 and one coupling button 3102, the coupling unit 310 may be modified to include two coupling buttons 3102 mounted on opposite ends of the resilient arm 3101 for engaging corresponding holes 319, 318 in the tubular parts 317, 316 of the rod body 313', thereby further enhancing stability of the top frame rod 31.

When storing the top frame rods 31, the coupling button 3102 of each top frame rod 31 is pressed to retract into the second tube part 317 of the corresponding rod body 313', and the first and second tube parts 316, 317 are pulled apart from each other. In view of the two-part configuration of each rod body 313', the length of the top frame rods 31 can be reduced to result in lower packaging and transport costs.

In this embodiment, the first and second tube parts 321, 322 of each of the couplers 32 are mutually orthogonal, and the number of the couplers 32 is four, thereby resulting in a rectangular top frame unit 3. However, in practice, by altering the angle between the first and second tube parts 321, 322 of each of the couplers 32, and the number of the couplers 32 in the top frame unit 3, the actual shape of the top frame unit 3 can be varied as well.

In sum, the baby crib 2 of this invention has a relatively simple construction that is easy to assemble and disassemble. Hence, manufacturing costs can be reduced, and packaging and transport costs are also lower when compared with the conventional foldable baby crib due to the relatively small size of the disassembled top frame unit 3.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A baby crib comprising:

a bottom frame unit; a top frame unit; and a plurality of support rods that interconnect said bottom frame unit and said top frame unit, wherein said top frame unit includes:

a plurality of three-way couplers, each of which including a root part and first, second and third tube parts that extend in different directions from said root part, said root part including a thread-less cap-receiving recess hole through said first tube part, said third tube part being sleeved on a respective one of said support rods; and a plurality of top frame rods, each of which includes a rod body that has opposite first and second rod ends, and a thread-less anchor cap mounted on said first rod end of said body and shaped to engage said cap-receiving recess hole without protruding from said root part, wherein a first top frame rod is configured to extend removably through said first tube part and said cap-receiving recess hole of a first coupler such that said anchor cap of the first top frame rod is disposed removably in said cap-receiving recess hole of said first coupler without protruding from said root part of said first coupler, wherein a second top frame rod is configured to extend removably through said first tube part and said cap-receiving recess hole of a second coupler such that said anchor cap of the second top frame rod is disposed removably in said cap-receiving recess hole of said second coupler without protruding from said root part of said second coupler, and wherein said plurality of three-way couplers comprises at least three identical three-way couplers.

2. The baby crib as claimed in claim 1, wherein said bottom frame unit is foldable and is operable so as to bring said support rods close to each other when said top frame rods are removed from said couplers.

3. The baby crib as claimed in claim 1, wherein said rod body of each of said top frame rods is a tubular body.

4. The baby crib as claimed in claim 3, wherein each of said top frame rods further includes a positioning unit for retaining releasably said rod body on said first tube part of said one of said couplers.

5. The baby crib as claimed in claim 4, wherein said rod body of each of said top frame rods is formed with a radial hole that is spaced apart from said anchor cap, said positioning unit including:

a U-shaped resilient arm disposed in said rod body; and a stop button mounted on one end of said resilient arm and extending through said radial hole in said rod body to arrest undesired removal of said rod body from said first tube part of said one of said couplers.

6. The baby crib as claimed in claim 1, wherein said rod body of each of said top frame rods includes first and second tubular parts that are interconnected removably and that are provided respectively with said first and second rod ends.

7. The baby crib as claimed in claim 6, wherein each of said top frame rods further includes a coupling unit for interconnecting releasably said first and second tubular parts of said rod body.

8. The baby crib as claimed in claim 7, wherein:

said second tubular part has an end segment inserted removably into said first tubular part and formed with a first radial hole;

said first tubular part is formed with a second radial hole to be aligned with said first radial hole in said second tubular part; and said coupling unit includes:

a U-shaped resilient arm disposed in said end segment of said second tubular part, and a coupling button mounted on one end of said resilient arm and extending through said first radial hole in said second tubular part and into said second radial hole in said first tubular part.

9. The baby crib as claimed in claim 1, wherein each of said anchor caps is configured to engage a respective one of said cap-receiving recess holes non-rotatably.

10. The baby crib as claimed in claim 1, wherein cap-receiving recess holes correspond in shape to said anchor caps.

11. A top frame unit adapted for connection to a plurality of support rods of a baby crib, said top frame unit comprising:

a plurality of three-way couplers, each of which includes a root part and first, second and third tube parts that extend in different directions from said root part, said root part including a thread-less cap-receiving recess hole through said first tube part, said third tube part being adapted to be sleeved on a respective one of the support rods; and a plurality of top frame rods, each of which includes a rod body that has opposite first and second rod ends, and a thread-less anchor cap mounted on said first rod end of said rod body and shaped to engage said cap-receiving recess hole without protruding from said root part, wherein a first top frame rod is configured to extend removably through said first tube part and said cap-receiving recess hole of a first coupler such that said anchor cap of the first top frame rod is disposed removably in said cap-receiving recess hole of said first coupler without protruding from said root part of said first coupler, wherein a second top frame rod is configured to extend removably through said first tube part and said cap-receiving recess hole of a second coupler such that said anchor cap of the second top frame rod is disposed removably in said cap-receiving recess hole of said second coupler without protruding from said root part of said second coupler, and wherein said plurality of top frame rods comprises at least three identical top frame rods.

12. The top frame unit as claimed in claim 11, wherein said rod body of each of said top frame rods is a tubular body.

13. The top frame unit as claimed in claim 12, wherein each of said top frame rods further includes a positioning unit for retaining releasably said rod body on said first tube part of said one of said couplers.

14. The top frame unit as claimed in claim 13, wherein said rod body of each of said top frame rods is formed with a radial hole that is spaced apart from said anchor cap, said positioning unit including:

a U-shaped resilient arm disposed in said rod body; and a stop button mounted on one end of said resilient arm and extending through said radial hole in said rod body to arrest undesired removal of said rod body from said first tube part of said one of said couplers.

15. The top frame unit as claimed in claim 11, wherein said rod body of each of said top frame rods includes first and second tubular parts that are interconnected removably and that are provided respectively with said first and second rod ends.

16. The top frame unit as claimed in claim 15, wherein each of said top frame rods further includes a coupling unit for interconnecting releasably said first and second tubular parts of said rod body.

17. The top frame unit as claimed in claim 16, wherein:

said second tubular part has an end segment inserted removably into said first tubular part and formed with a first radial hole;

said first tubular part is formed with a second radial hole to be aligned with said first radial hole in said second tubular part; and said coupling unit includes:

a U-shaped resilient arm disposed in said end segment of said second tubular part, and a coupling button mounted on one end of said resilient arm and extending through said first radial hole in said second tubular part and into said second radial hole in said first tubular part.

* * * * *